United States Patent [19]

Brown

[11] 4,050,698

[45] Sept. 27, 1977

[54] QUARTER CARD DECK

[75] Inventor: Albert Brown, Oakland, Calif.

[73] Assignee: The Raymond Lee Organization, Inc., New York, N.Y.

[21] Appl. No.: 675,722

[22] Filed: Apr. 12, 1976

[51] Int. Cl.[2] ..... A63F 1/00

[52] U.S. Cl. ..... 273/152.41; 35/70; 273/152.7 A; 273/157 R

[58] Field of Search ..... 273/152 R, 152.41, 157 R, 273/137 C, 137 D; 35/70, 71

[56] References Cited

U.S. PATENT DOCUMENTS

| | | | |
|---|---|---|---|
| 819,915 | 5/1906 | Nelson | 273/157 R |
| 1,129,604 | 2/1915 | Rice | 273/157 R |
| 1,702,505 | 2/1929 | Groves | 273/157 R |
| 2,383,081 | 8/1945 | Ribbe | 273/152 R |

FOREIGN PATENT DOCUMENTS

| | | | |
|---|---|---|---|
| 459,840 | 1/1937 | United Kingdom | 273/152.41 |

*Primary Examiner*—Anton O. Oechsle
*Attorney, Agent, or Firm*—Howard I. Podell

[57] ABSTRACT

A deck of cards for the assisting of improvement in children of learning skills of matching, counting, alphabet use, color use and providing simple games of fun. Each card of a fifty-two card deck depicts one-quarter of the picture of an animal in color, with each card of the four card set depicting a quarter-picture of a given animal identified by a common letter of the alphabet, a common numeral and an individual card suit symbol. Two different card decks are required for presentation of all letters of the alphabet. The name of the depicted animal may be marked on one or more cards and the picture of each card is drawn in a common scale so that four cards of different sets may be combined to form a picture of generally continuous outline which is a composite of quarter pictures of different animals.

1 Claim, 2 Drawing Figures

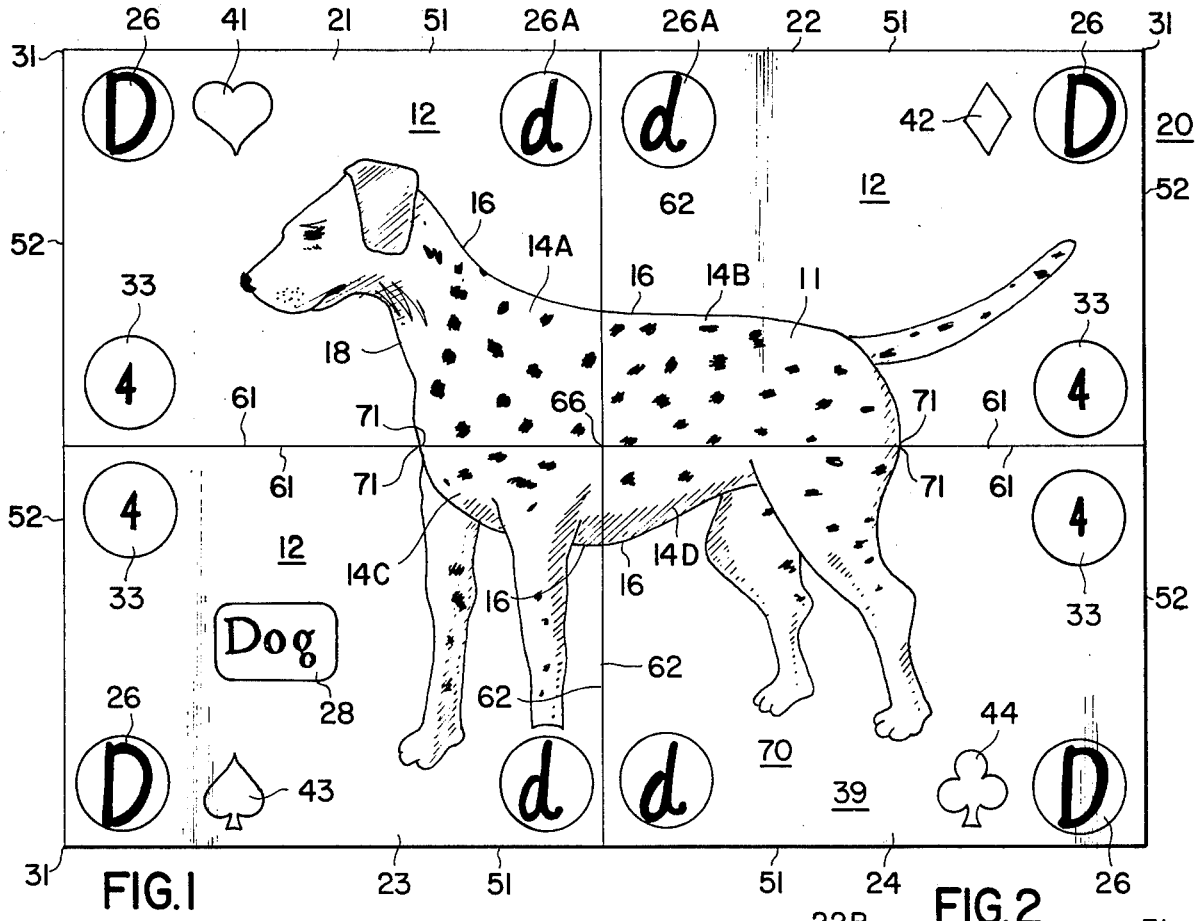
FIG.1
FIG.2
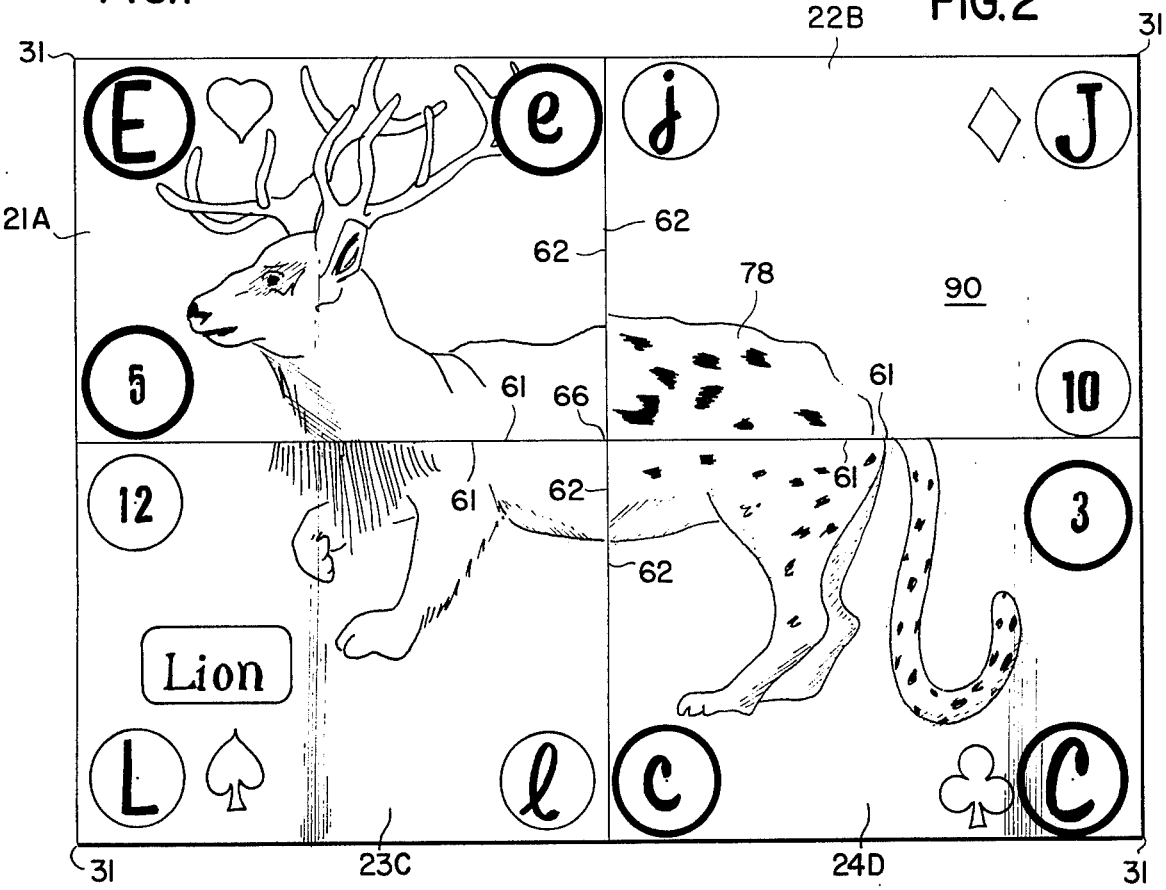

QUARTER CARD DECK

SUMMARY OF THE INVENTION

My invention is a deck of cards for assisting the improvement in children of learning skills of matching, counting, alphabet use, color use and providing simple games of fun. Each card of a fifty-two card deck depicts one-quarter of the picture of an animal in color, with each card of the four card set depicting a quarter-picture of a given animal identified by a common letter of the alphabet, a common numeral and an individual card suit symbol. Two different card decks are required for presentation of all letters of the alphabet. The name of the depicted animal may be marked on one or more cards and the picture of each card is drawn in a common scale so that four cards of different sets may be combined to form a picture of generally continuous outline which is a composite of quarter pictures of different animals.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a plan view of the arrangement of four cards of the invention of a set; and FIG. 2 is a plan view of the arrangement of four cards of the invention of four different sets.

DESCRIPTION OF THE PREFERRED EMBODIMENT:

Turning now descriptively to the drawings, in which similar reference characters denote similar elements throughout the several views, FIG. 1 illustrates the picture 11 of an animal 18 obtained by arranging four rectangular cards 21–24 of a common set 20 of the card deck of the invention to form a common rectangle 70.

The card deck of the invention consists of thirteen different sets 20 of four cards, such as 21–24, with the face side 12 of each card 21–24 depicting a quarter section 14A–14D of an animal 18, with the outline border 16 of each quarter section 14A–14D joining the border 16 of the two adjacent quarter sections so as to form a common colored picture of an animal 18, with all four cards 14A–14D are aligned together, as shown in FIG. 1, to form a common rectangle 70.

Each card 21–24 of a set 20 is marked with a common letter symbol 26 and with an individual suit symbol 41–44 adjacent an exterior corner 31 of a card.

Each card 21–24 of a set 20 is also marked with a common numeral 33 so that two different decks of twenty-six different sets of cards each display a different letter of the alphabet and may display twenty-six different numerals. Alternately, the card sets of two different decks may both display a common set of thirteen numerals. The thirteen sets of each card deck depict the pictures of thirteen different animals.

One or more cards 23 of a set may display a marking 28 listing the name of the animal 18 depicted on the cards 21–24 of the set 20 and the letter symbol 26 of the alphabet may be repeated at a second location 26A on each card 21–24 with one symbol 26 being marked as a capital letter and the script form of the same letter depicted at location 26A.

Each card may be colored with the common colored background 39 of each card 21–24 of a set 20 being of a different color than that of the backgrounds 39 of other cards of other sets, and with the color of the depicted animal 18.

The following detailed description of the cards 21–24 of a set 20 applies to all cards of all sets of a deck, except as has been, or is otherwise noted:

Each card 21–24 is of a uniform rectangular shape with a picture segment 14A–14D drawn as a quarter of a full picture of an animal 18. The cards are joined together so that one exterior corner 31 of each card 21–24 forms the exterior corner of a common rectangle 70, with two mutually perpendicular exterior edges 51 and 52 of each card meeting at a corner 31 of each card 21–24. The edges 61 and 62 of each card 21–24, opposed respectively to card edges 51 and 52, are each joined adjacent to an edge 61 and 62 respectively of two of the other cards of the set 20 with all card edges 61 and 62 meeting at the center point 66 of the rectangle 70, with center point 66 being the corner 66 of each card 21–24 diagonally opposed to exterior card corner 31.

The outline 16 of each picture segment 14A–14D is drawn to meet the outline 16 of each adjacent picture segment 14A–14D at an aligned card edge 61 and 62 when the four cards 21–24 of a set 20 are joined to form a common rectangle 70, with the outline 16 of all picture segments, and with all pictures of all animals of all the card sets being of a generally uniform size and uniformly located so that any card 21–24 of a given set 20 may be exchanged in position for a respective card of a different set to form a composite picture of an imaginary animal 78, as shown in FIG. 2, when four cards, card 21A of set 20A, card 22B of set 20B, card 23C of set 20C and card 24D of set 20D are joined at common corner 66 along common edges 61 and 62 to form a common rectangle 90.

Various rules of play may be utilized with the cards of the deck to train the users in recognition of letter, numeral and suit symbols 26, 33 and 44 respectively.

The back faces of each card (not shown) may be of uniform markings or else marked with distinctive patterns.

One game that may be played consists of dealing each player an initial quantity of cards, with the players subsequently drawing or exchanging cards to form complete pictures of the cards of a given set or to form composite pictures under pre-set rules.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A deck of playing cards for educational and play use, with each card of the deck formed of a uniform shape and marked on the face side of the card with a segment of a complete picture, with the cards marked as sets, in which each card of a set is marked with a different segment of a given complete picture, such that the complete picture is displayed when the cards of a set are aligned together to form a common pattern, in which each card is of a specific set of four cards, each card being of uniform rectangular shape, with each card marked on its face side with a quarter segment of a complete picture that is depicted when all four cards of a specific set are joined to form a common rectangle, with each set of four cards of the deck marked to display the figure of an animal, when assembled, with each specific set of four cards marked with a different picture, with each card of a specific set being marked on its face side with a different suit symbol of a set of four suit symbols, with each card of a specific set being marked with a common numerical sequential designation, said designation being individually different for each specific set of cards, such that thirteen different specific sets of such cards may be employed to make up a deck of fifty-two cards that may be employed, in play, as a conventional deck of playing cards, for playing card games that involve four sets of individually sequentially identified cards with each set marked as a different suit, or alternately the cards may be employed for games that involve matching of the picture segments of four cards of similar or different specific sets.

* * * * *